US010390639B2

(12) United States Patent
Lolik

(10) Patent No.: US 10,390,639 B2
(45) Date of Patent: Aug. 27, 2019

(54) MOUTHPIECE FOR DRINKING FROM BEVERAGE CANS

(71) Applicant: Marcin Lolik, Warsaw (PL)

(72) Inventor: Marcin Lolik, Warsaw (PL)

( * ) Notice: Subject to any disclaimer, the term of this patent is extended or adjusted under 35 U.S.C. 154(b) by 1 day.

(21) Appl. No.: 15/554,786

(22) PCT Filed: Mar. 27, 2016

(86) PCT No.: PCT/PL2016/050010
§ 371 (c)(1),
(2) Date: Aug. 31, 2017

(87) PCT Pub. No.: WO2016/159805
PCT Pub. Date: Oct. 6, 2016

(65) Prior Publication Data

US 2018/0042412 A1 Feb. 15, 2018

(30) Foreign Application Priority Data

Apr. 1, 2015 (PL) ..... 411823

(51) Int. Cl.
*A47G 19/22* (2006.01)

(52) U.S. Cl.
CPC ..... *A47G 19/2216* (2013.01)

(58) Field of Classification Search
CPC ..... A47G 19/2216; A47G 19/2266; A47G 19/2211; A47G 19/2205; A47G 21/185
USPC ..... 220/717, 718, 716, 703, DIG. 14
See application file for complete search history.

(56) References Cited

U.S. PATENT DOCUMENTS

| | | | | |
|---|---|---|---|---|
| 4,679,702 | A | 7/1987 | Maccarone | |
| 5,117,980 | A | 6/1992 | Ionides | |
| D671,795 | S | 12/2012 | Tai | |
| 2007/0221676 | A1* | 9/2007 | De Godoy | B65D 17/4012 220/716 |
| 2010/0012670 | A1* | 1/2010 | Massey | B65D 47/06 220/717 |
| 2011/0108561 | A1 | 5/2011 | Bonin | |

(Continued)

FOREIGN PATENT DOCUMENTS

| | | |
|---|---|---|
| WO | WO 1991-007125 | 5/1991 |
| WO | WO 2011-024012 | 3/2011 |

OTHER PUBLICATIONS

International Search Report issued in PCT/PL2016/050010 dated Nov. 7, 2016.

(Continued)

*Primary Examiner* — Robert J Hicks
(74) *Attorney, Agent, or Firm* — DLA Piper LLP US

(57) ABSTRACT

The invention relates to a drinking mouthpiece for cans in the form of a fitting fixed on a top rim of a can. The drinking mouthpiece is fixed on a flange of the can through a groove and rests on a top side of a lid of the can with a bottom part of wide wings. The drinking mouthpiece includes: a lower edge of a recess folded inwardly towards an inside of the can at the place of fixing to a lid opening, a protruding lobe positioned on the outside of the can with an oval shape drops onto a vertical wall of the can. The wings of drinking mouthpiece become narrower towards a upper part of the drinking mouthpiece, thereby forming a deepening recess between the wings with an additional smaller recess in the upper part of the drinking mouthpiece.

3 Claims, 4 Drawing Sheets

(56) References Cited

U.S. PATENT DOCUMENTS

Figure 1:
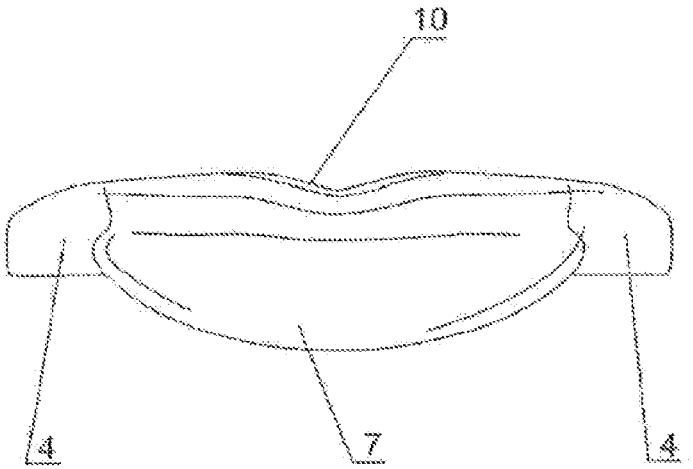

| | | | | |
|---|---|---|---|---|
| 2012/0204397 | A1 | 8/2012 | Tai | |
| 2013/0199989 | A1 * | 8/2013 | Carter | A47G 19/2266 210/464 |

OTHER PUBLICATIONS

Written Opinion issued in PCT/PL2016/050010 dated Nov. 7, 2016.
International Search Report issued in PCT/PL2016/050010 dated Jul. 11, 2016.
Written Opinion issued in PCT/PL2016/050010 dated Jul. 11, 2016.

* cited by examiner

MOUTHPIECE FOR DRINKING FROM BEVERAGE CANS

CROSS REFERENCE TO RELATED APPLICATIONS

This application is a U.S. National Stage Application of International Application No. PCT/PL2016/050010 filed Mar. 27, 2016, which claims priority from Polish Patent Application No. P.411823 filed Apr. 1, 2015. The entirety of all the above-listed applications are incorporated herein by reference.

The invention covers a drinking mouthpiece for cans containing either carbonated or noncarbonated beverages. It is intended for cans opened in a conventional way with a stay-tab which applies pressure to the cap creating an opening alongside the marked edge.

Beverage cans with the stay-tab opening mechanism are not hygienically secured for beverage consumption. When drinking or during other type of discharge (e.g. pouring the beverage into a different container) there is a high risk that the contaminants found on the outer surface of the can may get into the beverage and then to the human digestive system. Furthermore, the hole formed after opening the can has sharp edges, which in certain circumstances may cut the tongue during consumption. The mouthpiece described in the present invention is the solution for the above two risks associated with drinking from a can with the stay-tab opening mechanism.

Patent PL358235A1 describes a cap for a beverage can, in particular for a beer can, which consists of a mouthpiece and a hook, has a body in the shape of a spherical cap with the mouthpiece fixed on the external part and a hook on the side, wherein inside the surface of the spherical cap directly at the contact point with the can it has a peripheral latching projection. The body inside the surface of the spherical cap has a sealing lobe, and on the edge of the inner peripheral rim of the inner spherical cap it has a pressure (engaging) flange. The mouthpiece is shaped as a cylinder which has on its outer surface a thread divided into axial recesses. On its external surface the mouthpiece has a front area which is perpendicular to the axis, and inside a mesh area which is perpendicular to the axis wherein the mesh is dense enough to prevent insects, and especially wasps, from getting into the beverage. The hook that goes outside and on the side of the body has a recess resembling a rectangle and an outside lobe at the inflection point, while the length of the arm formed along the axis of the cap together with the lobe are matched in the way which allows for suspension of the unscrewed cap.

The EP870685A1 patent describes a plastic mouthpiece which is applied over the hole in the can's lid after opening. This mouthpiece is made from a piece of a sterile flexible plastic material approved for the use in food products and suitable for reuse. The material is bent in such a way that it has two opposite front surfaces, one concave and the other convex. From the front view, the edging of the plastic fitting resembles a rectangle in the shape of an isosceles trapezoid with rounded corners similar to the shape of a nail.

Patent EP1355831B1 describes an attachment consisting of an annular flange dimensioned in such a way that it can be snap mounted on the top of the can. The attachment has an opening which is placed directly above the opening in the top part of the can equipped with a mouthpiece pointing up. The mouthpiece has preferably and essentially a semicircular shape and allows for air to flow into the can when emptied.

Patent application WO2012/010725A1 describes a lid which is mounted onto the top of the can. It is shaped as a cup and has an oblique cone configuration with an oval opening at the top. Its top is located near the wall of the can and goes to the opening in the lid of the can through a neck.

Although the invention is explained below using only one version of the embodiment, the invention is not limited to the presented example. There are many possible variations and forms of the mouthpiece, especially regarding the production of the various forms and the use of various materials.

The main feature of the drinking mouthpiece for cans in the form of a fitting fixed on the top rim of the can, is that it is fixed on the flange of the can through a groove while simultaneously having its walls lean on the lid of the can, wherein its tip at the place of fixing to the opening in the lid of the can is folded inward, and the part sloping on to the vertical wall of the can has an oval edge, having a small recess formed on the top surface of the inside part.

The mouthpiece is made from plastic, preferably having antibacterial properties.

During production of the can, according to the present invention, the mouthpiece is mounted to the recess on the bottom of the can.

The invention is illustrated in embodiment drawings, in which

Figure 2:
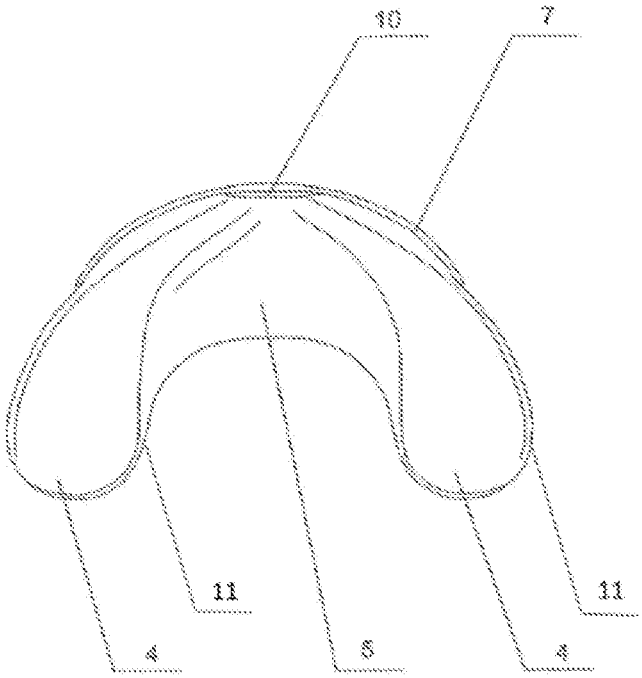
Figure 3:
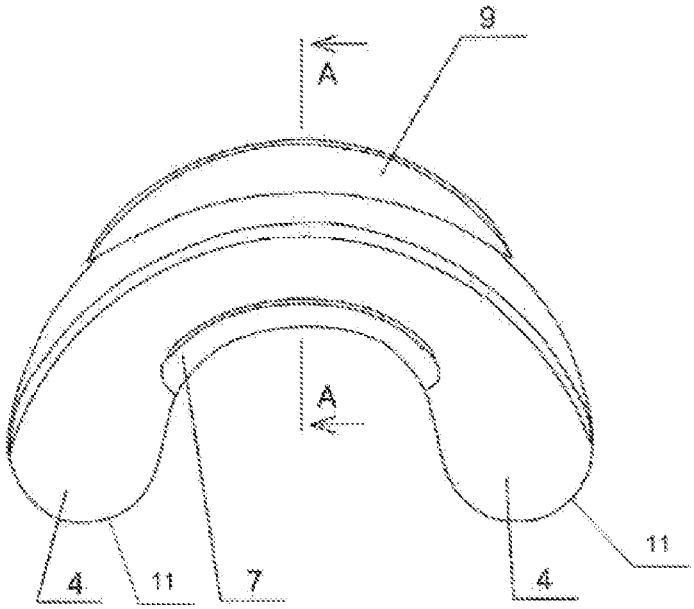
Figure 4:
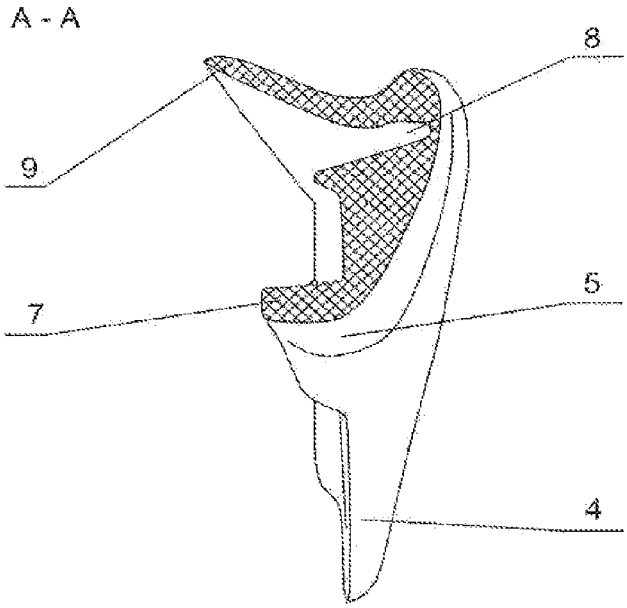
Figure 5:
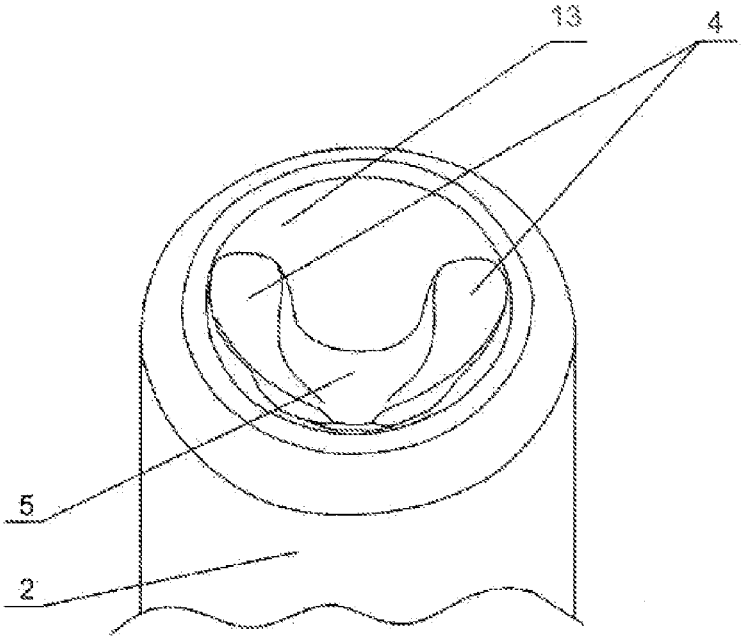
Figure 6:
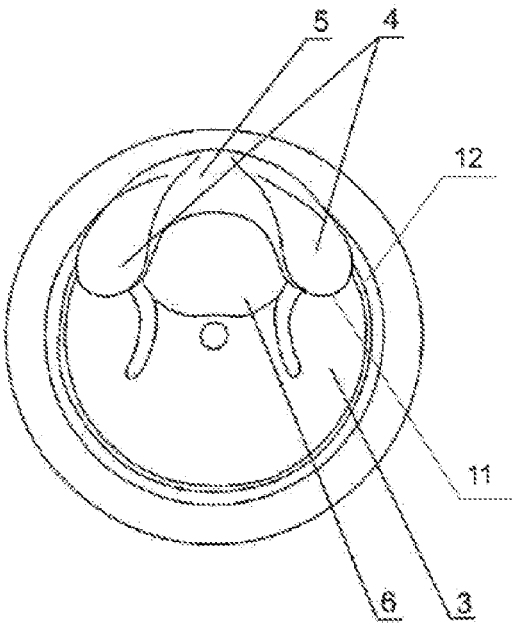
Figure 7:
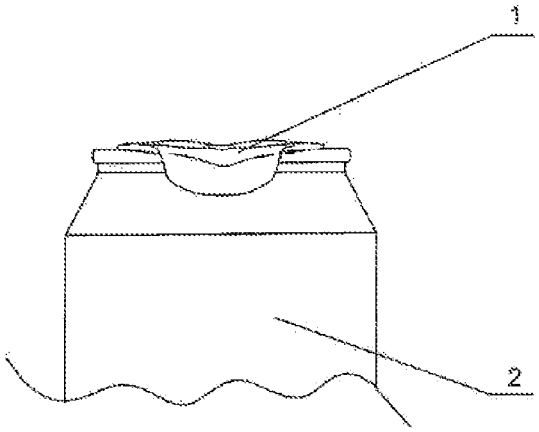
Figure 8:
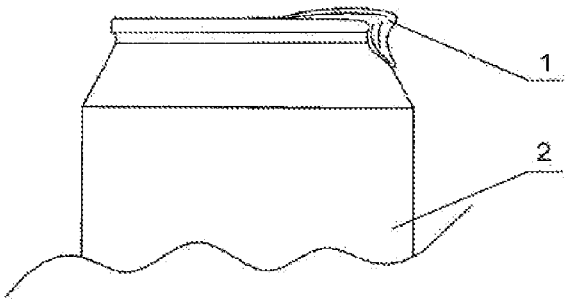
Figure 9:
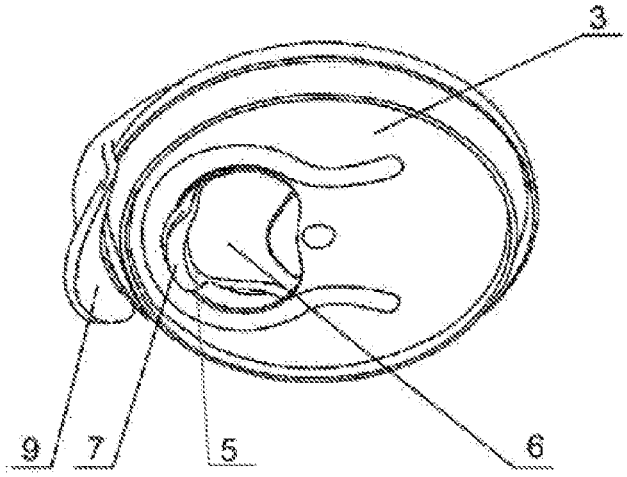

FIG. 1 shows the mouthpiece from the front view,

FIG. 2—mouthpiece from the top view,

FIG. 3—the mouthpiece from the bottom view,

FIG. 4—a cross section view of the mouthpiece along the A-A line in FIG. 1, FIG. 5—the mouthpiece mounted in the recess at the bottom of the can, FIG. 6—the mouthpiece mounted on the lid of the can from the top view, FIG. 7—the mouthpiece mounted on the lid of the can from the front view, FIG. 8—the mouthpiece mounted on the lid of the can from a side view, FIG. 9—the mouthpiece mounted on the lid of the can in the view from below.

The mouthpiece according to the present invention is made from silicon. From the top view it is shaped as letter U, whose wide wings 4 are widened and flattened on the ends. Moving in the opposite direction, the ends of the wings 4 become narrower, and between them there is a deepening recess 5 which, after fixing the mouthpiece1 on the lid 3, comes in contact with the opening 6, through which liquid located in the can 2 flows out upon breaking. The internal shape of the mouthpiece matches the shape of the opening 6. From the top view the upper surface of the wings 4 drops down slightly, the bottom part is horizontal, and its end part goes up assuming a horizontal position.

The mouthpiece 1 rests on the lid 3 of the can 2 with the bottom part 11 of the wings 4 and the edge 7 of the recess 5 which is adapted to the shape of the opening 6 at the point of attachment to the opening 6 is bent inward enveloping the sharp edge of the opening 6 and ensuring the tightness of the connection. This prevents the tongue from being cut on the edge formed after opening the can.

The mouthpiece 1 is fixed to the upper flange 12 of the can 2 in such a way that the beverage does not flow between the mouthpiece and the can. In the groove 8, which is the contact point with the flange 12, the mouthpiece 1 in horizontal cross section has the shape of a circular segment consistent with the shape of the flange 12.

After fixing the mouthpiece 1 on the flange 12 of the can 2 and the lid 3 of the can 2, on the outside of the can there protrudes the lobe 9 with the oval bottom edge. It goes down along the vertical wall of the can and supports the bottom lip of the drinking person.

The upper lip of the drinking person has contact with the surface of the recess 5 of the mouthpiece 1 with an additional small recess 10 corresponding to the shape of the tubercle of the upper lip.

The mouthpiece, according to the present invention, has a simple construction and is at the same time useful while providing safety during consumption of liquids from cans. It separates the mouth of the drinking person from the outer surface of the can, which may be dirty, and protects the tongue from being cut on the sharp edges of the opening which form after the can has been opened.

During production the mouthpiece is mounted in a recess 13 on the bottom of the can, which is ergonomic in terms of transport and does not take away any of the can's properties (e.g. the possibility to put one can on top of another). The mounting is done by means of an adhesive that is neutral towards food products.

The mouthpiece is protected from contamination either by foiling which separates it from external contamination or by covering the outer part of the mouthpiece with peel foil, which would be removed only at the moment of mounting the mouthpiece onto the can ensuring its cleanliness until this time.

The mouthpiece, according to the present invention, is mounted to the edge of the can opening ensuring tightness and causing the liquid to flow down the mouthpiece rather than down the outer surface of the can when tilted.

The invention claimed is:

1. A drinking mouthpiece for cans in the form of a fitting adapted to be fixed on a top rim of a can, the drinking mouthpiece adapted to be fixed on a flange of the can through a groove and resting on a top side of a lid of the can with a bottom part of wide wings, wherein:

a lower edge of a first recess is adapted to fold inwardly towards an inside of the can at the place of fixing to a lid opening when the mouthpiece is placed on the can, a protruding lobe is positioned on the outside of the can with an oval shape which is adapted to drop onto a vertical wall of the can when the mouthpiece is placed on the can, and the wings become narrower towards au upper part of the drinking mouthpiece, thereby forming the first recess deepening between the wings with an additional smaller recess in the upper part of the drinking mouthpiece.

2. The mouthpiece of claim 1, wherein the mouth piece is made from plastic having antibacterial properties.

3. The mouthpiece of claim 1, wherein the mouth piece is adapted to be mounted to a second recess on a bottom of the can.

* * * * *